US009261244B2

(12) United States Patent
Wimbert et al.

(10) Patent No.: US 9,261,244 B2
(45) Date of Patent: Feb. 16, 2016

(54) LED LAMP WITH LAYERED LIGHT MODIFYING ELEMENT

(71) Applicant: Flextronics Automotive GmbH & Co KG, Rickenhausen (DE)

(72) Inventors: Frank Wimbert, Owen (DE); Philip Hupfer, Burgthann (DE)

(73) Assignee: Flextronics Automoive GmbH & Co. KG, Frickenhausen (DE)

( * ) Notice: Subject to any disclaimer, the term of this patent is extended or adjusted under 35 U.S.C. 154(b) by 118 days.

(21) Appl. No.: 13/757,357

(22) Filed: Feb. 1, 2013

(65) Prior Publication Data

US 2014/0009929 A1 Jan. 9, 2014

(30) Foreign Application Priority Data

Feb. 2, 2012 (DE) ..... 20 2012 100357

(51) Int. Cl.

| | |
|---|---|
| ***F21V 9/08*** | (2006.01) |
| ***F21K 99/00*** | (2010.01) |
| ***F21V 9/10*** | (2006.01) |
| *F21Y 101/02* | (2006.01) |
| *F21Y 103/00* | (2006.01) |

(52) U.S. Cl.

CPC ... *F21K 9/56* (2013.01); *F21V 9/08* (2013.01); *F21V 9/10* (2013.01); *F21Y 2101/02* (2013.01); *F21Y 2103/003* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,596,095 | A * | 7/1971 | Leach | 250/461.1 |
| 6,068,383 | A * | 5/2000 | Robertson et al. | 362/84 |
| 7,052,152 | B2 * | 5/2006 | Harbers et al. | 362/30 |
| 7,101,061 | B2 * | 9/2006 | Nagai et al. | 362/294 |
| 7,641,370 | B2 | 1/2010 | Heine et al. | |
| 7,750,359 | B2 * | 7/2010 | Narendran et al. | 257/98 |
| 8,055,023 | B2 | 11/2011 | Goto et al. | |
| 8,539,702 | B2 * | 9/2013 | Li et al. | 40/564 |
| 2006/0261970 | A1 | 11/2006 | Colacecchi | |
| 2008/0205075 | A1 | 8/2008 | Hikmet et al. | |
| 2009/0262526 | A1 * | 10/2009 | Lin et al. | 362/231 |
| 2011/0292659 | A1 * | 12/2011 | Hsieh et al. | 362/311.01 |
| 2013/0148362 | A1 * | 6/2013 | Kostuch | 362/307 |

* cited by examiner

*Primary Examiner* — Ismael Negron
(74) *Attorney, Agent, or Firm* — Haverstock & Owens LLP

(57) ABSTRACT

An LED lamp includes at least one light source and at least one translucent plastic element disposed in the beam path of the at least one lighting means. The plastic element includes at least two plastic layers made of different translucent materials, the translucency of each one of the two plastic layers having a different wavelength dependence such that the overall transmission function of the at least one plastic member is a desired value.

11 Claims, 6 Drawing Sheets

LED LAMP WITH LAYERED LIGHT MODIFYING ELEMENT

RELATED APPLICATIONS

This Application claims priority under 35 U.S.C. §119(a) through (d) of the German Patent Application No. 20 2012 100 357.0 filed Feb. 2, 2012, which is hereby incorporated by reference in its entirety.

FIELD OF THE INVENTION

The present invention relates to a lamp, in particular an LED lamp having at least one light source and having a translucent plastic member which is arranged in the beam path of light emitted from the at least one light source.

BACKGROUND OF THE INVENTION

The backlighting of translucent plastic elements, such as push-button caps with backlit icons, with narrow light sources, such as color LEDs, is easy to control the light transmitted to the eye of a viewer because the color varies only minimally with the wall thickness of the push-button caps. Therefore, the brightness of an LED can be adjusted by varying the wall thickness of the push-button caps.

With a broadband light source such as a white LED, however, it is more complicated. With a broadband light source, both brightness and light color may vary with the wall thickness of the material covering the light source. Varying the wall thickness of the material covering the light source to produce a homogeneous illumination of the symbol on the covering can vary the color that reaches a viewer's eye. Often move to warmer white translucent materials white light through the material back shades.

FIG. 7 shows an example of the prior art. A conventional lamp 41 comprises a white LED 42 with a white translucent plastic element 43 with constant wall thickness. The plastic element 43 is in the path of the emitted white light 44 of the LED 42. During the passage of the white light 44 by the white plastic element 43, the white light 44 is shifted towards yellow as shown by the arrow 45.

FIG. 8 shows another example of a prior art lamp 51. The lamp 51 comprises a white LED light 52 and white translucent plastic element 53 having a varying thickness (in this figure, wedge-shaped). The plastic element 53 is disposed in the beam path of the emitted white light 54 of the LED 52. The LED 52 is positioned approximately equidistant from the right and left ends of the plastic element 53, such that the intensity of the emitted white light 54 is approximately the same at each end of the plastic element 53. When the emitted white light 54 passes through the white translucent plastic element 53, the white light 54 is shifted towards yellow, and does so more the thicker the wall thickness of the white translucent plastic element 53. As indicated by the different gray arrows 55*a* and 55*b*, the light (indicated by arrow 55*a*) emitted through the plastic element 53 at the tip of the wedge is brighter and whiter than the dimmer, yellower light (indicated by arrow 55*b*) emitted through the plastic element at the stump of the wedge formed by the white translucent plastic element 53, as indicated by the magnitude and shading of the arrows 55*a* and 55*b*. Due to the wedge shape, as light passes through the wedge stump more light is absorbed than light passing through the thinner wedge tip, such that the result of the light passing through has different intensities on the wedge stump and wedge tip, as indicated by the different lengths of arrows 55*a* and 55*b*.

SUMMARY OF THE INVENTION

In contrast, it is an object of the present invention, to provide a lamp to control the passage of light through the plastic element such that, even with different wall thicknesses of the plastic element, a homogenous color is displayed.

The plastic element comprises two plastic layers of different materials, wherein the translucency of the two layers of plastic have a different wavelength dependence such that the overall transmission function of at least one plastic element is changed in a desired manner, or such that the color shift of the light of the light source passing through the plastic layers takes place in a desired manner.

Preferably, the color shift of the light passing through the at least one plastic element is smaller than the color shift of the light passing through one of the at least two layers of plastic.

According to the invention, the second plastic layer changes the wavelength dependent translucency of the plastic element in such a way that, for example, homogenized in that the light color is shifted to the desired target color. In the white translucent plastic materials of the prior art, shift towards warmer colors can be compensated with the second plastic layer. That the remote, outer plastic layer forms the visible light without passing tag design color the plastic element, the color of the transmitted light and wavelength dependency of translucency can be optimized through the inner plastic layer.

Where the filter-compensating, the translucency of the two layers of plastic, for example, an opposing wavelength dependence or each opposing have stepped wavelength dependencies.

A further application is the specific color shift by at least one additional plastic layer towards a desired chromaticity. Thus, for example, with just one light source a multi-colored illuminated symbol can be realized. In plain cold design is ideally same for all positions of the plastic element approximation, that the color shift in passing through the two layers of plastic is constant and leads to the desired target color. This is especially to be calculated thickness profiles for the outer plastic layer (e.g., color keys required) and reaches for the inner plastic layer.

Preferably, the plastic element comprises at least two plastic layers, and can be formed by injection molding.

Preferred embodiments of the invention are the subject of the dependent claims. Further advantages of the invention will be apparent from the Description and the Drawings. Likewise, the above and the following characteristics can be used individually or in any combination. The figures are intended to illustrate the features of the invention. The invention is not to be construed as limited to only the embodiments shown in the figures.

DETAILED DESCRIPTION OF THE DRAWINGS

Figure 1:
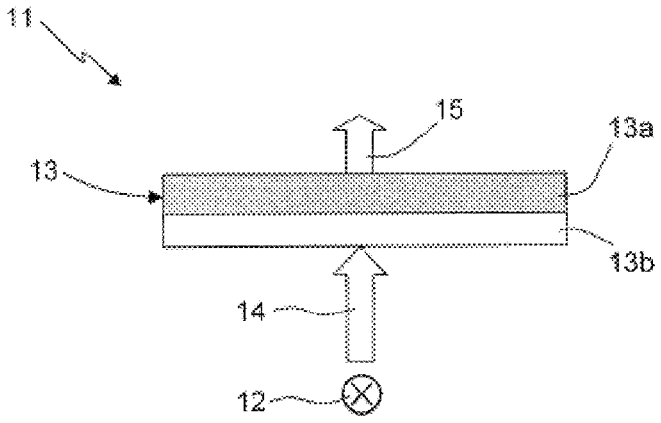
FIG. 1 shows a first lamp according to the invention with a double-translucent plastic member wherein the light color of the light passed to the viewer does not change, and preferably is virtually independent of the wavelength of light transmitted through the plastic member.

In FIG. 1, a lamp 11 includes a broadband light source, such as white LED 12, and a translucent plastic element 13 with a constant thickness. The plastic element 13, is disposed in the beam path of the emitted white light 14 of the LED 12. The plastic element 13 comprises two plastic layers, 13*a* and 13*b* made from materials having different translucency, T1 and T2, respectively. The graph of FIG. 3*a* shows characteristics common to outer plastic layers such as the plastic layer 13*a* from FIG. 1, the element 23*a* from FIG. 2, and the element 66*a* from FIG. 6. The graph of FIG. 3*b* shows characteristics common to inner plastic layers such as the plastic layer 13*b* from FIG. 1, the element 23*b* from FIG. 2, and the element 66*b* from FIG. 6. As shown in FIG. 3*a* and FIG. 3*b*, the common characteristics shown in FIG. 3*a* have an opposite wavelength dependence than the common characteristics shown in FIG. 3*b*. In the remote, in the outer plastic layer characteristics shown in FIG. 3*a*, the translucency T1 increases in as the wavelength increases in the visible range wavelength. The inner plastic layer characteristics shown in FIG. 3*b*, in contrast, have translucency T2 that decreases as the wavelength increases in the visible range wavelength. The contrasting wavelength dependencies of the characteristics of the two plastic layers shown in FIG. 3*a* and 3*b* result in a wavelength-independent translucency T of the translucent plastic member 13, as shown in FIG. 3*c*. The plastic layer 13*a* on the outside (e.g. an outer plastic layer) is the transmitted light without visible, for example, white or gray tag design color of the plastic member 13, whereas via the plastic layer 13*b* on the inside (e.g. an inner plastic layer), the wavelength dependence of the translucency of the plastic layer 13*a* is compensated for and thus prevents a color shift of the passing light 15. During the passage of the white LED light 14 through the plastic element 13 there is no color shift, as indicated by the continuing white arrow 15.

Figure 2:
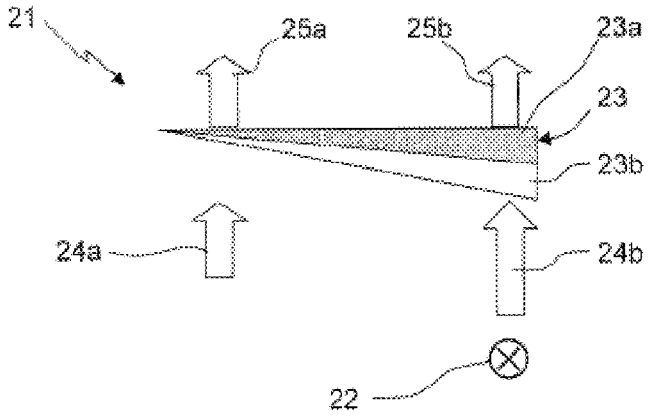
FIG. 2 shows a second lamp according to the invention with a double-wedge-shaped translucent plastic member wherein the light color of the light passed to the viewer does not change, and preferably is virtually independent of the wavelength of light transmitted through the plastic member.
Figure 3A:
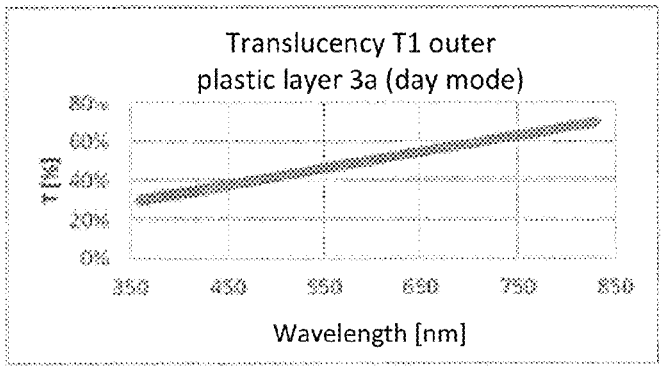
FIGS. 3*a*-3*c* show a first example of the translucency of the type shown in FIG. 1 and FIG. 2 and its two plastic layers (FIGS. 3*a*, 3*b*) as a function of wavelength (FIG. 3*c*).
Figure 3B:
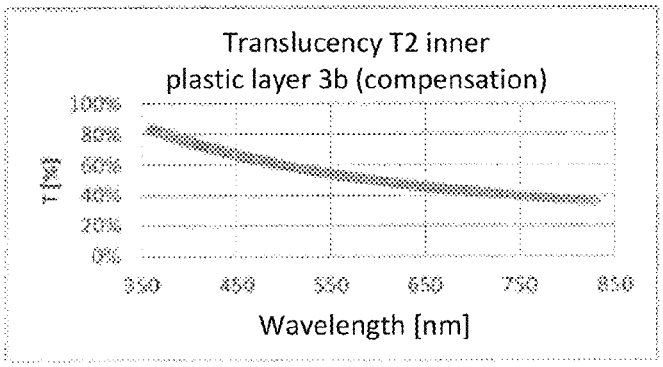
Figure 3C:
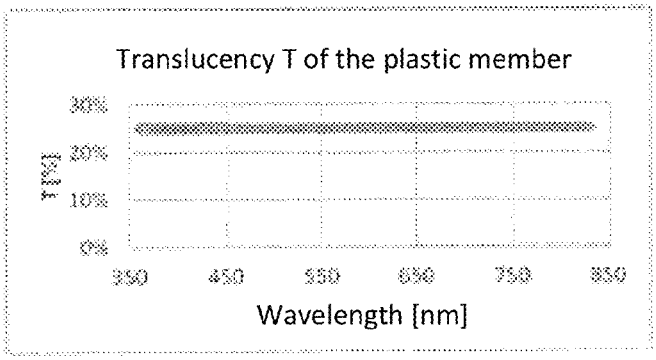

FIG. 2 shows a lamp 21 comprising a white LED light source 22 and a wedge-shaped translucent plastic member 23 that comprises two wedge-shaped plastic layers, 23*a* and 25*b*. The plastic member 23 is disposed on the optical path of the emitted white light 24*a* and 24*b* from the LED 22. The emitted white light 24*a* and 24*b* passes through each of two wedge-shaped plastic layers 23*a* and 23*b*. The two wedge-shaped plastic layers 23*a* and 23*b* are formed from different translucent materials. Analogous to FIG. 1, the two layers of plastic, 23*a* and 23*b*, are of opposite wavelength dependence, as shown in FIGS. 3*a* and 3*b*. The thickness of the inner plastic layer 23*b* increases with the thickness of the outer plastic layer 23*a*, so that during the passage of the white LED light 24*a* and 24*b* by the plastic element 23, no color shift takes place, as indicated by the continuing white arrows 25*a* and 25*b*. The LED 22 is closer to the right, thicker end than to the left, thinner end of the plastic member 23 so that the light 24*a* has a lower intensity at the left end than the intensity of the light 24*b* incident on the right end, as shown by the shorter arrow 24*a* and the longer arrow 24*b*. Due to the wedge shape, as light 24*b* passes through the right end of the wedge, more light is absorbed as it passes through the plastic element 23 than is absorbed at the thinner wedge tip on the left. As a result, the light 25*a* and 25*b* passing through the plastic element 23 has the same intensity at the wedge stump on the right as at the wedge tip on the left, as indicated by the arrows 25*a* and 25*b* being of equal length. During the passage of the white LED light 24*a* and 24*b* by the wedge-shaped plastic member 23, the intensity of the light passing 25*a* through the plastic member 23 is thus homogenizing, without a color shift of the light passing through 25*a* and 25*b*.

Figure 4A:
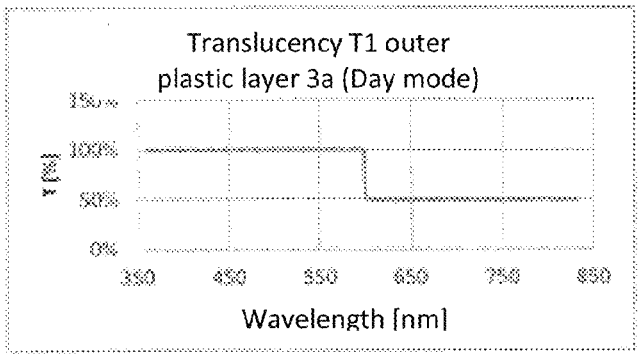
FIGS. 4*a*-4*c* show a second example of the translucency of the type shown in FIG. 1 and FIG. 2 and its two plastic layers (FIGS. 4*a*, 4*b*) as a function of wavelength (FIG. 4*c*).
Figure 4B:
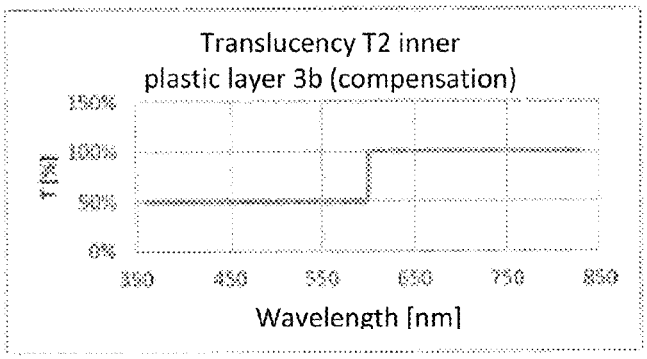
Figure 4C:
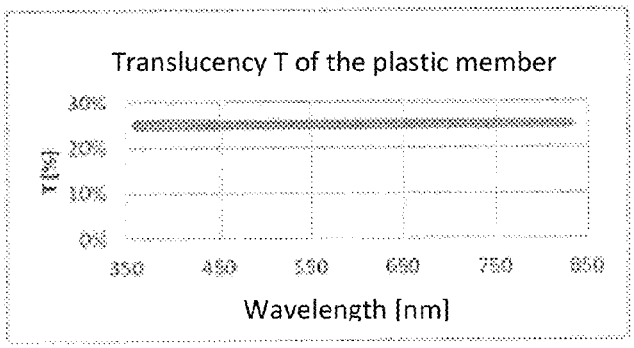

As shown in FIGS. 4*a* and 4*b*, the translucency T1 and T2 of the two plastic layers 3*a* and 3*b*, respectively, is stepped. By using the opposing wavelength dependencies of translucence T1 and T2, at two plastics layers 3*a* and 3*b*, a translucency of the same wavelength is provided. These opposing stepped wavelength dependencies of the two plastic layers 3*a* and 3*b*, formed from two compensating filters, result in a wavelength-independent translucency T of the plastic element 3, as shown in FIG. 4*c*.

Figure 5A:
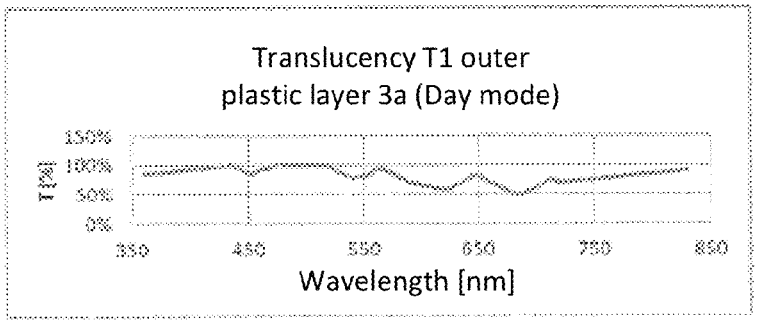
FIGS. 5*a*-5*c* show a third example of the translucency of the type shown in FIG. 1 and FIG. 2 and its two plastic layers (FIGS. 5*a*, 5*c*) as a function of wavelength (FIG. 5*c*).
Figure 5B:
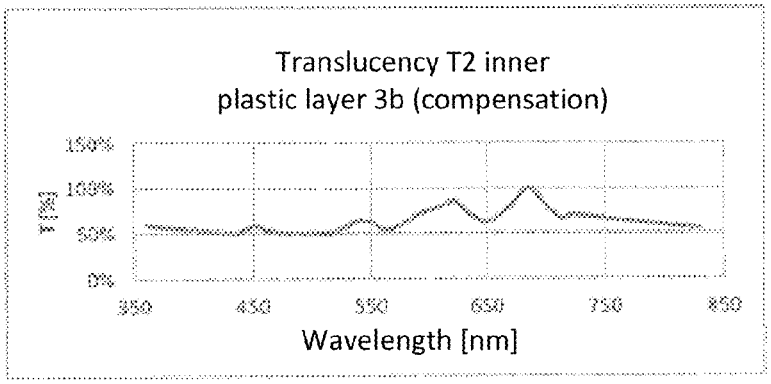
Figure 5C:
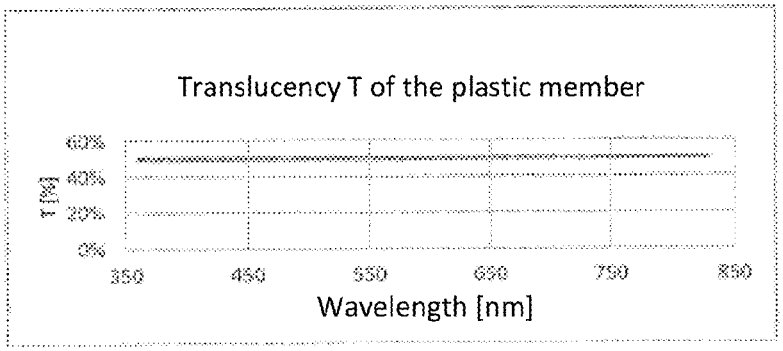

As shown in FIGS. 5*a* and 5*b*, the two plastic layers 3*a* and 3*b* each have several rising sections and several corresponding failing sections of wavelength dependence. The wavelength dependencies of the two plastic layers 3*a* and 3 b are approximately mirror images of each other, resulting in a wavelength-independent translucency T of the plastic member 3, as shown in FIG. 5*c*.

Instead of the shown two layers of plastic, the plastic member, of course, three or more layers of plastic can be formed as a multi-component injection-molded part.

Figure 6:
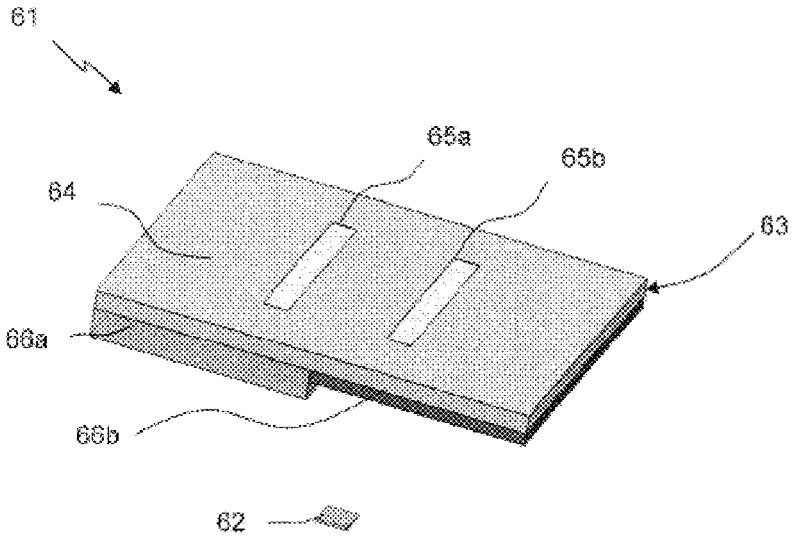
FIG. 6 shows a further inventive lamp with a key cap in the form of a translucent three-component plastic element.
Figure 7:
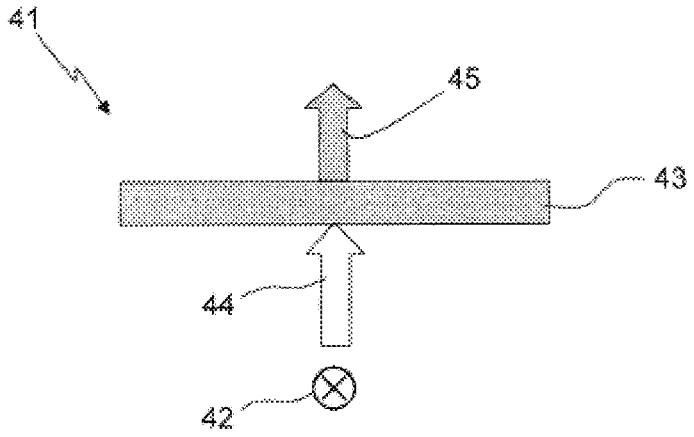
Fig. 7 (Prior art)
FIG. 7 is a lamp according to the prior art with a translucent plastic element, wherein the wavelength of the light emitted to a viewer is dependent on the translucency of the plastic element.
Figure 8:
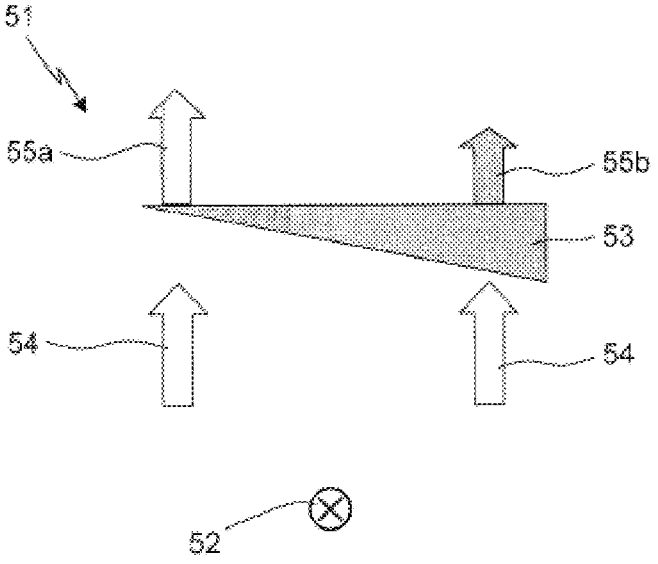
Fig. 8 (Prior art)
FIG. 8 shows a further lamp according to the prior art with a translucent plastic element, wherein the wavelength of the light emitted to a viewer is dependent on the translucency of the plastic element and varies with thickness of the plastic element.

FIG. 6 shows a lamp 61 comprising an LED 62, and a translucent key cap having a three-component plastic element 63. The plastic element 63 is arranged in the beam path of the light emitted from the LED 62. The plastic element 63 comprises an outer translucent plastic layer 64, which is painted on the outside, opaque in a desired color and daylight design, and two non-painted symbol areas 65*a* and 65*b*. The plastic member 63 has two differently colored inner translucent plastic layers 66*a* and 66*b*, wherein the inner plastic layer 66*a* behind the inner half of the outer plastic layer 64 that has the symbol 65*a*. The other plastic layer 66*b* is behind the half of the outer plastic layer 64 that has the symbol 65*b*. The outer plastic layer 64 does not transmit visible light and can be formed, for example, in a white or gray tag design color of the plastic element 63. The inner plastic layers 66*a* and 66*b* lead to different colors of screened symbols 65*a* and 65*b*, respectively.

What is claimed is:

1. A lamp comprising:

an LED having at least one light source; and at least one translucent plastic element disposed in a beam path of the at least one light source, wherein the at least one translucent plastic element comprises at least two plastic layers made from different translucent materials, the translucency T1 and T2 of the at least two plastic layers each having a different wavelength dependence, wherein the at least one translucent plastic element has a translucency T that is wavelength-independent such that the translucency T does not vary based on the wavelength of the light.

2. The lamp according to claim 1, characterized in that the color shift of the light passing through the at least one plastic element is smaller than the color shift of the light passing through one of the at least two plastic layers.

3. The lamp according to claim 1, characterized in that the translucency T1 and T2 of the at least two plastic layers have an opposite wavelength dependence.

4. The lamp according to claim 1, characterized in that the LED comprises a phosphorus converted LED.

5. The lamp according to claim 1, characterized in that the LED comprises an organic light emitting diode (OLED).

6. The lamp according to claim 1, characterized in that a first one of the at least two plastic layers forms an outer layer that is one of white and gray.

7. The lamp according to claim 1, characterized in that the translucency at least one of the at least two plastic layers has both a rising and a falling wavelength dependence.

8. The lamp according to claim 1, characterized in that first one of the at least two plastic layers forms an outer layer, the outer layer having a thickness that is dependent on a distance from the outer layer to the at least one light source.

9. The lamp according to claim 8, characterized in that a second one of the at least two plastic layers forms an inner layer having a thickness that is dependent on one of: the thickness of the outer layer and distance to the at least one light source.

10. The lamp according to claim 1, characterized in that the translucency of at least one of the at least two plastic layers has a stepped wavelength dependence.

11. The lamp according to claim 10, characterized in that the translucency T1 and T2 of two of two of the at least two plastic layers each have opposing stepped wavelength interdependence.

* * * * *